US006379202B1

(12) United States Patent
Liu

(10) Patent No.: US 6,379,202 B1
(45) Date of Patent: Apr. 30, 2002

(54) UNDERWATER CLAMP-TYPE RELEASE APPARATUS

(75) Inventor: Ruey-Shan Liu, Kaohsiung (TW)

(73) Assignee: Chung-Shan Institute of Science and Technology, Taoyuan (TW)

( * ) Notice: Subject to any disclaimer, the term of this patent is extended or adjusted under 35 U.S.C. 154(b) by 0 days.

(21) Appl. No.: 09/546,242

(22) Filed: Apr. 10, 2000

(51) Int. Cl.[7] ..... B63B 22/06

(52) U.S. Cl. ..... 441/2; 294/66.1; 294/82.3; 294/82.33

(58) Field of Search ..... 441/2; 114/50, 114/51, 297, 221 R; 367/4, 133; 294/82.3, 82.33, 66.1

(56) References Cited

U.S. PATENT DOCUMENTS 5,022,013 A * 6/1991 Dalton et al. ..... 441/2
5,513,886 A * 5/1996 Cyr ..... 294/82.3

* cited by examiner

*Primary Examiner*—Sherman Basinger
(74) *Attorney, Agent, or Firm*—J.C. Patents

(57) ABSTRACT

An underwater clamp-type release apparatus has a main body and a release mechanism. The main body includes a housing, a motor stand, and a speed reducing gear motor while the release mechanism includes a base plate, a pair of clamp frames, a clamp, and a rotationally controlled block. The clamp is positioned between the two clamp frames and is pivotally connected to the clamp frames with a pin installed through holes in the clamp and the clamp frames. The top end of the clamp has a concave part for clamping and holding the working piece. The rotationally controlled block includes a bottom block, and an annular wall wherein the size of the inner diameter of the annular wall can just fit to contain the second end of the pair of the clamp arms when they are closed, and wherein the annular wall includes two openings opposite each other (180-degrees apart), and the total width of the second end of the clamp arms when they are closed allows them to pass through the openings when the two clamp arms are tending to open. Therefore, when the rotationally controlled block is controlled to turn an angle of 90-degrees, the two clamp arms are aligned with the openings at the rotationally controlled block to be opened, and the working piece is released.

4 Claims, 5 Drawing Sheets

UNDERWATER CLAMP-TYPE RELEASE APPARATUS

BACKGROUND OF THE INVENTION

1. Field of the Invention

The invention relates to an underwater clamp-type release apparatus, and more particularly to an electrically controlled underwater clamp-type release apparatus.

2. Description of Related Art

As referring to a prior art of the U.S. Pat. No. 5,022,013, FIG. 1 and FIG. 2 are partial cross-sectional views of an underwater clamp-type release apparatus showing in closed state and open state respectively. As shown in FIG. 1 and FIG. 2, a release apparatus 24 has a clamp 36 that is positioned between two plates 56 and is pivotally connected at a pin 38. The clamp 36 has a pair of clamp arms 62. Each of the clamp arms has one end including a curve jaw 66, a concave part 68, and a clamped surface 70 for clamping and holding a working piece 22. The other end of the clamp arm is contained in a coupling 48 (as will be depicted later) when the clamp arms are in closed state.

When a motor 50 is started, it drives a gear train having gear 74 and lead screw 76. Consequently, the gear train makes the central shaft 58 of the release apparatus 24 push a plunger 46 to slide back and forth in a cylinder 44 wherein the plunger 46 has a plurality of water-tight-seal 72. A coupling 48 having a recess 50 at the bottom surface thereof is fixed to the lower end of the central shaft 46. A bottom plate having a recess 60 facing downward is attached to an end cap 34 as shown in FIG. 1. When the clamp arms 62 are in closed state, the top ends of the clamp arms 62 are contained in the recess 50 of the coupling 48. But when central shaft 58 together with the coupling 48 is driven to move up, the clamp arms 62 are broken away from the coupling 48 that in sequence cause the clamp 36 to open. Consequently, the clamp arms 62 are changed from the closed state to an open state to release a working piece 22 as shown in FIG. 2.

Prior art's technology in the U.S. Pat. No. 5,022,013 as described above makes use of the motor 50 that can generate linear displacement at the output end. The motor 50 is coupled with a gear 74 that meshes and drives a lead screw 75, and in sequence, makes the coupling 48 at the output end move up and down in order to control the closed and the open states of the clamp 36. Therefore, a displacement space between the coupling 48 and the release apparatus 24 is necessary. But oftentimes, when the coupling 48 of the underwater clamp-type release apparatus 24 is pulled upward and going to be contained in the recess 60, foreign objects such as shell fish in the sea may be clogged in the recess 60. This will cause the coupling 48 to fail to be contained in the recess 60 under the end cap 34. Consequently, the release apparatus 24 is unable to open the clamp arms 62, and eventually, to release the working piece 22.

Moreover, the opening of the prior art's clamp arms 62 relies on the motor 50 to drive the transmission of the meshing gear train 74, 76 to make the coupling 48 (equivalent to a rotationally controlled block 140 as will be depicted later in the present invention) perform linear movement. When the coupling 48 touches the top ends 64 of the clamp arms 62, the clamp arms 62 clamp the working piece 22. But when the coupling 48 moves up to separate from the top ends 64 of the clamp arms 62, the clamp 36 is released to open the clamp arms 62. Since this kind of gear-and-lead screw meshing movement is very slow, the efficiency of the releasing work for the working piece 24 is significantly affected.

What is more, the overall structure, particularly the transmission mechanism 74 and 76 of the release apparatus 24 of the prior art is rather complicated. As a result, the required parts are a lot, thereby, not only it is inconvenient to operate but the maintenance is not easy and costly, consequently, the manufacturing cost and sale price are rather high.

SUMMARY OF THE INVENTION

The invention is directed to an improved underwater clamp-type release apparatus that can smoothly and efficiently complete a working piece releasing work without being interfered because of the clogging at the release mechanism of the foreign objects such as shellfish in bodies of water.

The invention is also directed to an improved underwater clamp-type release apparatus employing a "rotationally controlled block" to be turned only a 90-degree angle to be able to release a working piece. A microswitch is also employed to position the 90-degree turned "rotationally controlled block" and to switch off the power supply. This is not only positive in action, convenient in operation, but is also able to improve the working efficiency.

The invention is further directed to an improved underwater clamp-type release apparatus that is simple in design, facilitative in operation, and low cost in manufacturing.

The underwater clamp-type release apparatus of the invention has a main body and a release mechanism. The main body includes a housing, a motor stand, and a speed reducing gear motor while the release mechanism includes a base plate, a pair of clamp frames, a clamp, and a "rotationally controlled block". The clamp is positioned between the two clamp frames and is pivotally connected to the clamp frames at a pin installed through the holes at the clamp and the clamp frames. The top end of the clamp has a concave part for clamping and holding the working piece. The "rotationally controlled block" includes a bottom block, and an annular wall wherein the size of the inner diameter of the annular wall can just fit to contain the second end of the pair of the clamp arms when they are closed, and wherein the annular wall includes two openings opposite each other (180-degree apart), and the total width of the second end of the clamp arms when they are closed can make them just pass the openings when the two clamp arms are tending to open. Therefore, when the "rotationally controlled block" is controlled to turn an angle of 90-degree, two clamp arms are aligned with the openings at the "rotationally controlled block" to be opened, and the working piece is released.

When an electrically controlled type of operation is employed for the release apparatus, a cable is passed through the penetrating hole at the bottom of the housing in the main body, and after the wiring work for installing switches and various devices is completed, the release apparatus is thrown into the sea, power is switched on to actuate the "speed reducing gear motor", and until the apparatus is sunk into a predetermined set depth, the rotationally controlled block is turned an angle of 90°. And the clamp arms are aligned with the openings to be released from the "rotationally controlled block", consequently, the working piece is released, in the meantime, the microswitch is propped up by the cam to position the camshaft and to switch off the power.

BRIEF DESCRIPTION OF DRAWINGS

The invention can be more fully understood by reading the following detailed description of the preferred embodiment, with reference made to the accompanying drawings as follows:

FIG. 5(*b*) is an isometric view of the underwater clamp-type release apparatus showing the open state of its clamp according to the present invention.

DETAILED DESCRIPTION OF PREFERRED EMBODIMENT

Figure 1:
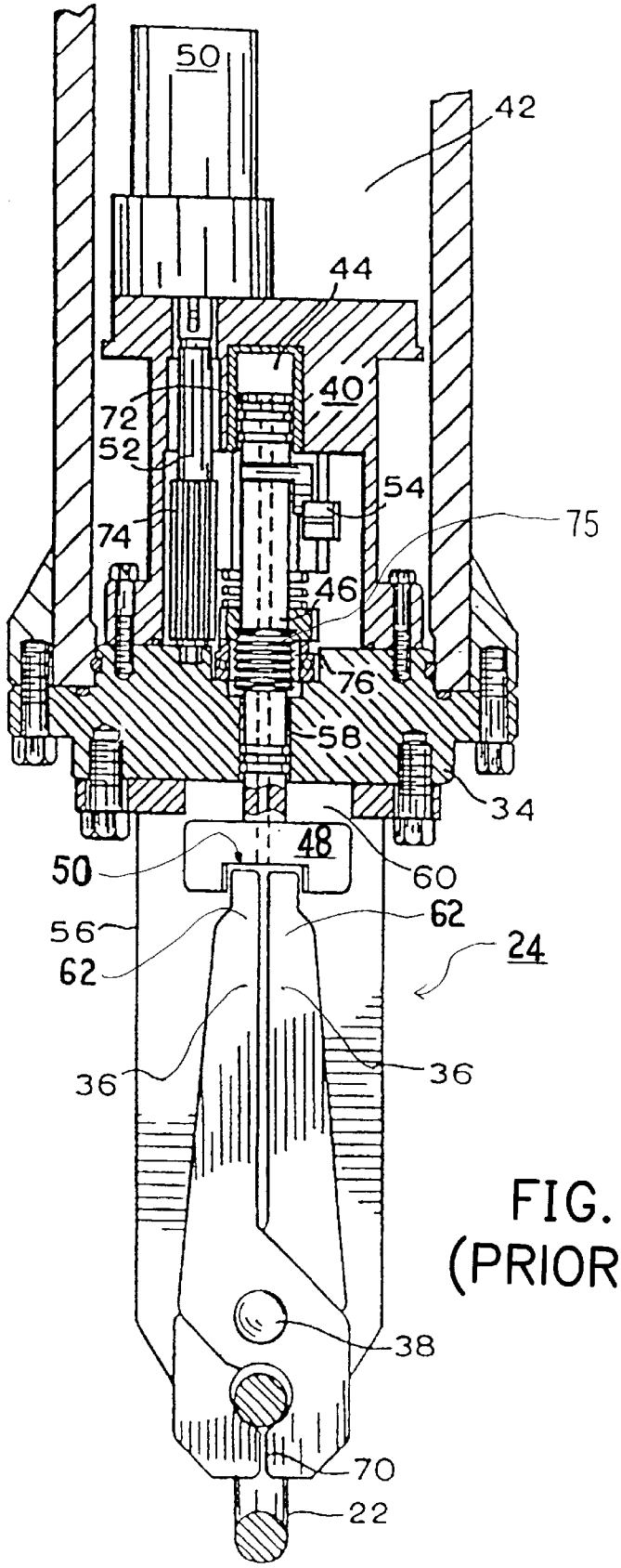
FIG. 1 (PRIOR ART)
FIG. 1 is a partial cross-sectional view of the underwater clamp-type release apparatus showing the closed state of its clamp according to the prior art.
Figure 2:
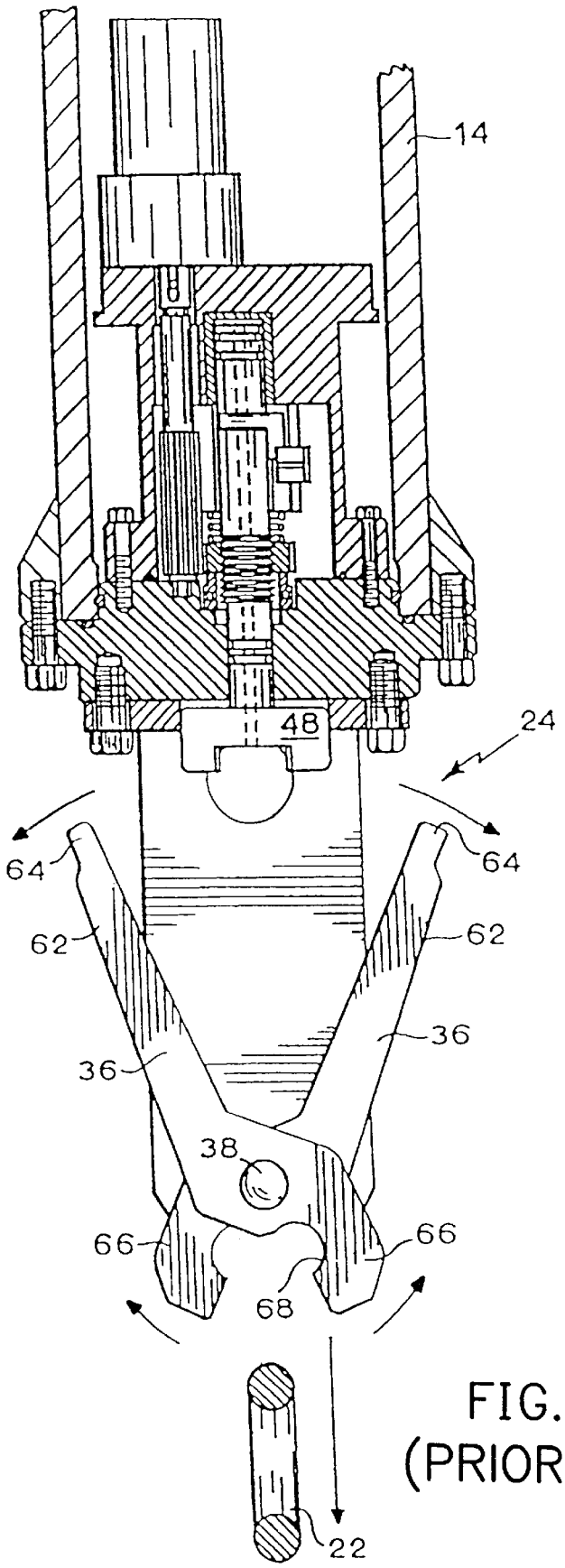
FIG. 2 (PRIOR ART)
FIG. 2 is a partial cross-sectional view of the underwater clamp-type release apparatus showing the open state of its clamp according to the prior art.
Figure 3:
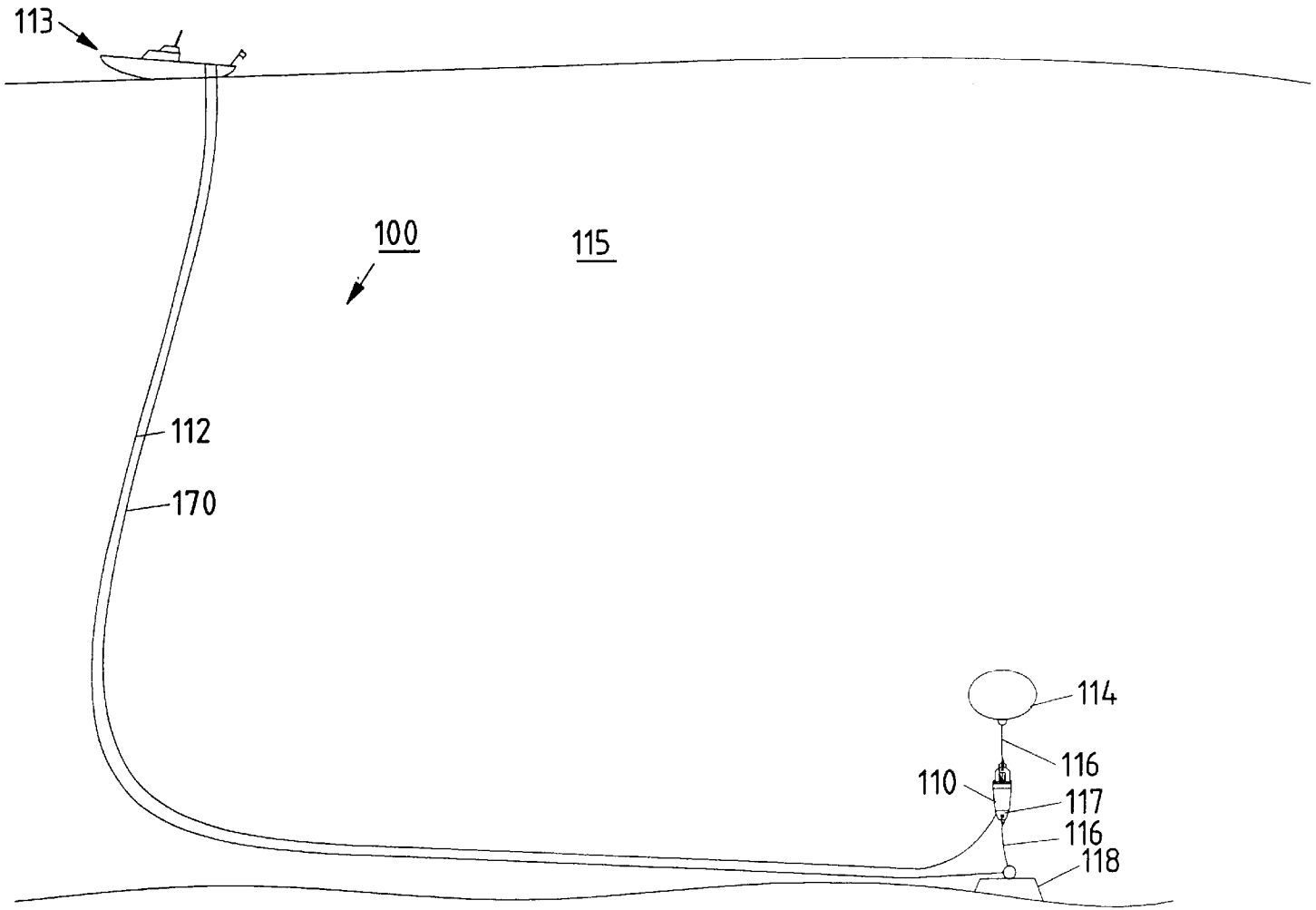
FIG. 3 is a schematic diagram of the underwater release system according to the present invention.

FIG. 3 is a schematic diagram of an underwater release system according to the present invention. The underwater release system includes a surface vessel 113 on a water body 115, a retrieving rope 112, a cable line 170, a release apparatus 110, a subsurface buoy 114, and an anchor 118. The subsurface buoy 114 holds the upper end of the release apparatus 110 in up-right direction through a mooring rope 116 while the anchor 118 moors the lower end of the release apparatus at the lug 117 through the mooring rope 116.

Figure 4:
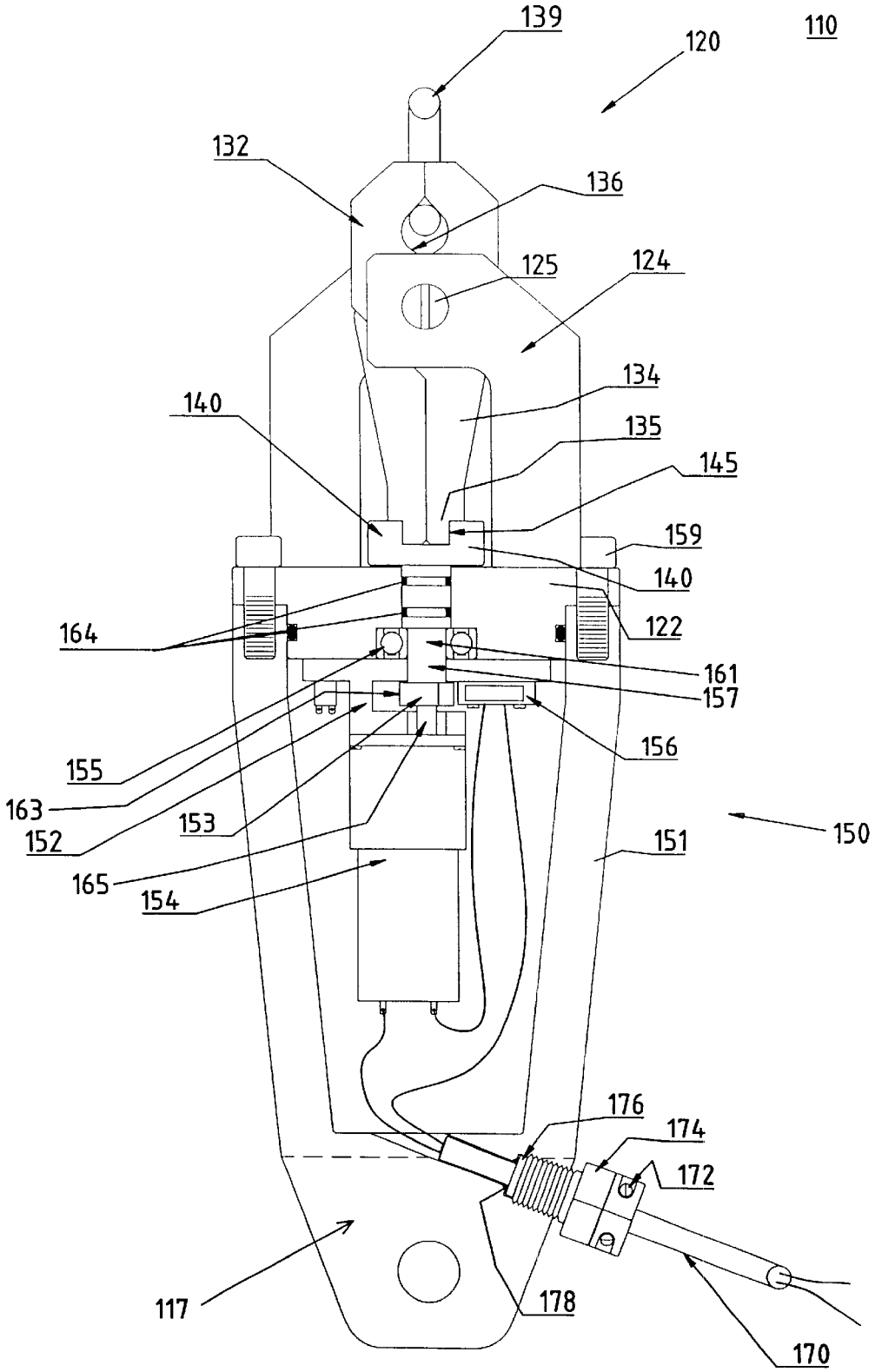
FIG. 4 is a partial cross-sectional view of the underwater clamp-type release apparatus showing the closed state of its clamp according to the present invention.
Figure 6:
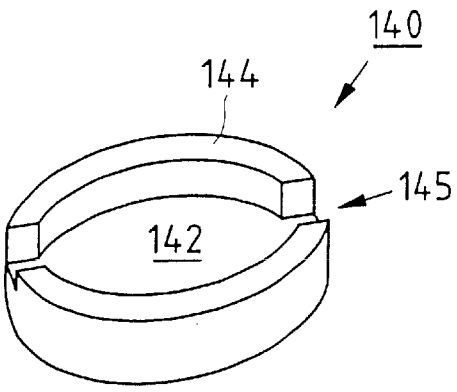
FIG. 6 is an isometric view of the "rotationally controlled block" of the underwater clamp-type release apparatus according to the present invention.
Figure 5B:
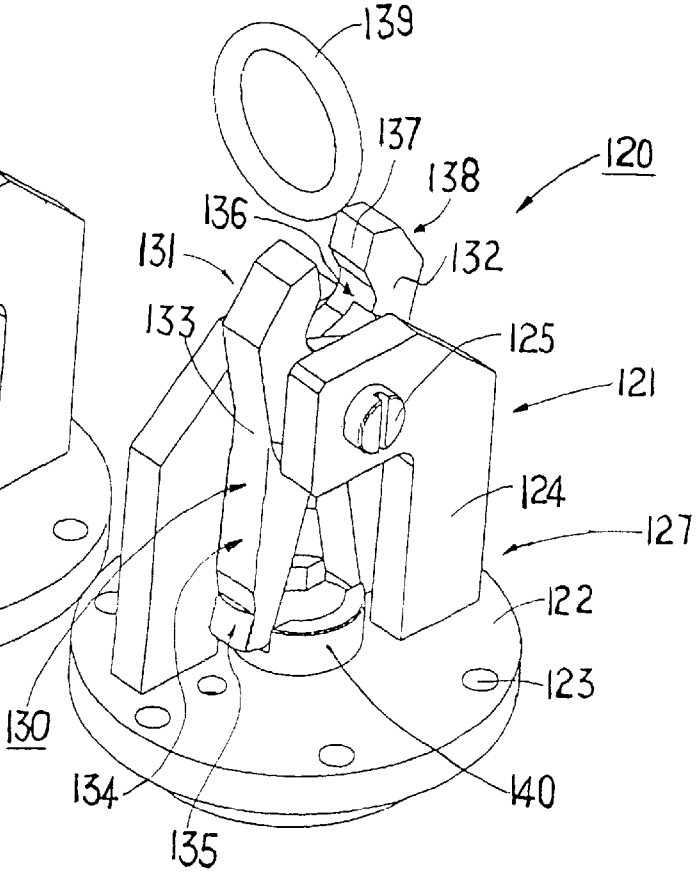
FIG. 5(*a*) is an isometric view of the underwater clamp-type release apparatus showing the closed state of its clamp according to the present invention.
Figure 5A:
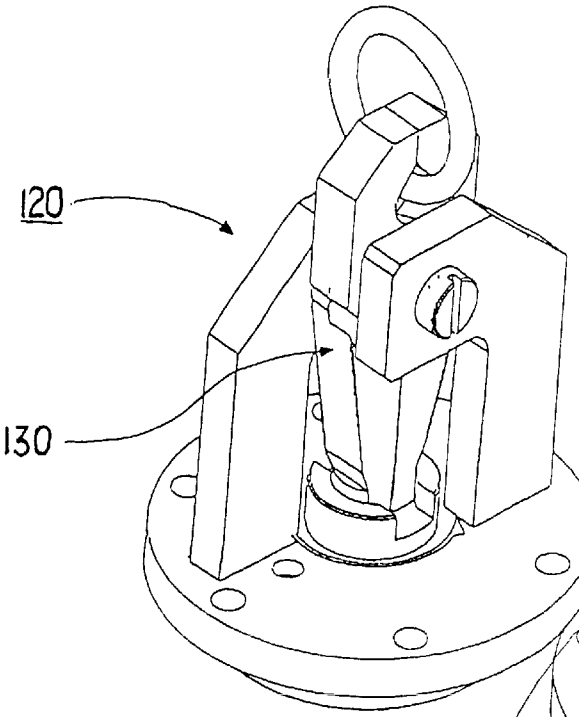

With reference to FIGS. 4, 5(*a*), 5(*b*) and FIG. 6, they are the schematic structural drawings of underwater clamp-type release apparatus 110. Among them, FIG. 4 is a partial cross-sectional view of the underwater clamp-type release apparatus 110 showing the closed state of its clamp, FIG. 5(*a*) is an isometric view of the underwater clamp-type release apparatus showing the closed state of its clamp, FIG. 5(*b*) is an isometric view of the underwater clamp-type release apparatus showing the open state of its clamp, and FIG. 6 is an isometric view of the "rotationally controlled block" of the underwater clamp-type release apparatus. An underwater clamp-type release apparatus 110 has a main body 150 and a release mechanism 120. The main body 150 includes a housing 151, a motor stand 152, a speed reducing gear motor 154, a bearing 155, a camshaft 157, and a microswitch 156. The housing 151 has a plurality of screw holes and the lower end of the bottom of the housing 151 has a lug 117 for tying the lower end of the housing 151 in order to keep the apparatus 110 in a certain direction. The bottom of the housing 151 has also a penetrating hole (not shown) such that a cable line 170 can penetrate through the hole. The cable line 170 includes a washer 176, an O-ring 178, a water-tight screw 174, and a cable line fastening screw 172. The motor stand 152 has a penetrating hole (not shown) at its center. The speed reducing gear motor 154 fixing on the motor stand 152 includes a speed reducer (not shown) and a motor (not shown). The camshaft 157 includes a first end 161, a center section 163, and a second end 165 wherein the first end 161 is penetrated through the central penetrating hole of the motor stand 152 while the second end 165 is connected directly to the motor shaft (not shown). Also, there is a "position-controlled switch cam" 153 attached to the center section 163 while the microswitch 156 is attached to a side of the "position-controlled switch cam" 156.

The release mechanism 120 includes a base plate 122, a pair of clamp frames 124, a clamp 130, and a "rotationally controlled block" 140. The base plate 122 having a penetrating hole (not shown) positioned at its center and a plurality of screw holes (not shown) positioned at the circumference thereof is fixed to the housing 151 by employing a plurality of bolts 159 tightened at the screw holes of the housing 151. A pair of clamp frames 124, each of them having inverted-L in shape includes an upper half portion 121 and a lower half portion 127 wherein the lower half portion 127 is fixed on the base plate 122 while the upper half portion 121 has a hole (not shown) and wherein the two clamp frames 124 have a portion of their upper half portions 121 that are parallel and overlapped by facing each other with their holes aligned with each other. A clamp 130 has a pair of clamp arms 134. Each of the clamp arms 134 includes a first end 131, a center section 133, and a second end 135 wherein the center section 133 has a hole (not shown). The clamp 130 is inserted between the pair of clamp frames 124 and has a pin 125 penetrated through the holes on the clamp frames 124 and on the clamp arms 134. The clamp arms 134 are pivotally connected to the clamp frames 124 through the pin 125. Also the first end 134 is a clamp mouth 138 that includes an curved portion 132, a clamped surface 137, and a concave portion 136 for tightly clamping and holding the working piece 139. A "rotationally controlled block" 140 appearing in ashtray shape includes a bottom block 142, and an annular wall 144. The size of the inner diameter of the annular wall 144 can just fit to contain the second end 135 of the pair of the clamp arms 134 when they are closed to contact each other on their clamped surfaces (not shown), and wherein the annular wall 144 includes two openings 145 opposite each other (180 degree apart), and the total width of the second end 135 of the clamp arms 134 when they are closed can make them just pass the openings 145 when the two clamp arms 134 are tending to open.

An electrically controlled type of operation can be employed for the release apparatus 110. First of all, a cable 170 is passed through the penetrating hole (not shown) at the bottom of the housing 151 in the main body 150. After the wiring work for installing switches and various devices is completed, the release apparatus 110 is thrown into the sea, power is switched on to actuate the "speed reducing gear motor", and until the apparatus is sunk into a predetermined depth, the "rotationally controlled block" is turned an angle by 90°. Consequently, the clamp arms 134 are aligned with the openings 145 to be released from the "rotationally controlled block" 140. As a result, the working piece 139 is released, and in the meantime, the microswitch 156 is propped up by the "position-controlled switch cam" 153 to position the camshaft 157 and to switch off the power, and the releasing work of working piece 139 is then completed. Afterward, the anchor 116 and the release apparatus 110 can be retrieved by the use of the retrieving rope 112.

An acoustically controlled type or timing type of operation can be employed for the release apparatus 110 of the invention. The release apparatus 110 has batteries (not shown) installed for providing power source, and a hydraulic switch (not shown) mounted. As the release apparatus 110 is thrown into the water till it is sunk to a predetermined depth, the hydraulic switch is opened. An acoustic receiver or a timer are installed to start the "speed reducing gear motor" by use of an "acoustic signal transmitter" or by use of the timer to count down until a predetermined time to actuate the "speed reducing gear motor". In this way, the release apparatus 110 of the invention can attain the object of releasing the working piece 139 through the control of the "rotationally controlled block" 140.

The operation of the release apparatus 110 of the invention can be employed for releasing objects on land such as laying tetrapod for river bank protecting engineering. But a hoist carriage instead of acoustically controlled receiver or a timer is used. In this case, a "wireless remote control signal transmitter" or "cable control" can be employed to attain the object of releasing the working piece 139.

To summarize the foregoing statement, The underwater clamp-type release apparatus of the present invention includes at least the following advantages:

1. The underwater clamp-type release apparatus of the present invention makes use of the "rotationally controlled block". When it comes to set for clamping the working piece, what one has to do is to tightly clip and turn the "rotationally controlled block" by one's thumb and the index finger in counter-clockwise direction. While in releasing the working piece, what one has to do is to tightly clip and turn the "rotationally controlled block" by one's thumb and the index finger in clockwise direction. Thus, the release apparatus can smoothly complete the work of releasing the working piece without being disturbed by the foreign objects such as the shellfish etc. in the sea.
2. The underwater clamp-type release apparatus of the present invention makes use of a motor to directly drive a "rotationally controlled block". Therefore, as comparing with the "gear to lead screw" transmission of the prior art, the driving torque and the speed of the present invention are greater than those of the prior art. Besides, the "rotationally controlled block" of the underwater clamp-type release apparatus of the present invention can release the working piece by only turning an 90 degree angle. Moreover, the time required for releasing or clamping the working piece of the present invention is much shorter than that of the prior art that uses the lead screw to move up and down. What is more, the release apparatus makes use of a microswitch for positioning and switching off the power source makes the present invention positive in action, convenient in operation and efficient in the releasing or clamping work.
3. The underwater clamp-type release apparatus of the present invention is simple in design, easy and low cost in manufacturing, convenient and low cost in maintenance.

The invention has been described using an exemplary preferred embodiment. However, it is to be understood that the scope of the invention is not limited to the disclosed embodiment. On the contrary, it is intended to cover various modifications and similar arrangements. The scope of the claims, therefore, should be accorded the broadest interpretation so as to encompass all such modifications and similar arrangements.

What is claimed is:

1. A release mechanism in an underwater clamp-type release apparatus, comprising:

a base plate, having a penetrating hole positioned at the center and a plurality of screw holes positioned at the circumference thereof a pair of clamp frames, each of them having an inverted L-shape and each of them comprising an upper half portion and a lower half portion wherein the lower half portion is fixed on the base plate while the upper half portion has a hole, and wherein the two clamp frames have a portion of their upper half portions that are parallel and overlapped by facing each other with their holes aligned with each other;

a clamp, having a pair of clamp arms and each of the clamp arms comprising a first end, a center section, and a second end wherein the center section has a hole, and the clamp is inserted between the pair of clamp frames and has a pin penetrated through the holes on the clamp frames and on the clamp arms, and the clamp is pivotally connected to the pin, also and the first end is a clamp mouth that comprises a curved portion, a clamped surface, and a concave portion, for tightly clamping and holding a working piece; and a rotationally controlled block, comprising a bottom block, and an annular wall wherein the size of the inner diameter of the annular wall can just fit to contain the second end of the pair of the clamp arms when they are closed to contact each other on their clamped surfaces, and wherein the annular wall includes two openings opposite each other, and the total width of the second end of the clamp arms at a close state allows the clamp arms to pass through the openings when the two clamp arms are tending to open;

wherein when the rotationally controlled block is turned an angle of 90, the two closed clamp arms are able to align with the openings in order to let the two clamp arms open to release the working piece.

2. An underwater clamp-type release apparatus, having a main body and a release mechanism, the main body comprising:

a housing, having a plurality of screw holes wherein the lower end of the bottom of the housing has a lug for tying the lower end of the housing in order to keep the apparatus in a certain direction, and the bottom of the housing has also a penetrating hole a motor stand, having a penetrating hole at the center;

a speed reducing gear motor, being mounted on the motor stand, which the gear motor comprises a speed reducer and a motor;

a camshaft, comprising a first end, a center section, and a second end wherein the first end is penetrated through the central penetrating hole of the motor stand while the second end is directly connected to a motor shaft, wherein there is a position-controlled switch cam attached to the center section, a microswitch, attached to a side of the position-controlled switch cam; and the release mechanism comprising:

a base plate, having a penetrating hole positioned at the center and a plurality of screw holes positioned at the circumference thereof, fixed to the housing by employing a plurality of bolts tightened at the screw holes of the housing a pair of clamp frames, each of them having an inverted L-shape and each of them comprising an upper half part and a lower half part wherein the lower half part is fixed on the base plate while the upper half part has a hole, and wherein the two clamp frames have a portion of their upper half parts that are parallel and overlapped by facing each other with their holes aligned with each other;

a clamp, having a pair of clamp arms and each of the clamp arms comprising a first end, a center section, and a second end wherein the center section has a hole, and the clamp is inserted between the pair of clamp frames and has a pin penetrated through the holes on the clamp frames and on the clamp arms, and the clamp is pivotally connected at the pin, also and the first end is a clamp mouth that comprises a curved part, a clamped surface, and a concave part, for tightly clamping and holding a working piece; and a rotationally controlled block, comprising a bottom block, and an annular wall wherein the size of the inner diameter of the annular wall can just fit to contain the second end of the pair of the clamp arms when they are closed to contact each other on their clamped surfaces, and wherein the annular wall includes two openings opposite each other, and the total width of the second end of the clamp arms at a close state allows the clamp arms to pass through the openings when the two clamp arms are tending to open, wherein an electrically controlled type of operation can be employed for the release apparatus, and when the release apparatus first is in the sea water, power can be switched on to actuate the speed reducing gear motor, and until the apparatus is sunk into a predetermined set depth, the rotationally controlled block can turn an angle of 90°, the clamp arms are aligned with the openings to be released from the rotationally controlled block, whereby the working piece is released, and in the meantime, the microswitch is propped up by the position-controlled switch cam to position the camshaft and to switch off the power.

3. The release apparatus of claim 2, wherein an acoustically controlled type or timing type of operation is employed for the release apparatus, and the release apparatus further comprises batteries used for providing a power source, and a hydraulic switch, wherein as the release apparatus is in the water at a predetermined depth, the hydraulic switch is opened, wherein the release apparatus is implemented with an acoustic receiver or a timer to start the speed reducing gear motor by an acoustic signal transmitter or the timer to count down for a predetermined time to actuate the speed reducing gear motor.

4. The release apparatus of claim 2, wherein the release apparatus is employed for releasing objects on land to lay a tetrapod for river bank protecting engineering.

* * * * *